United States Patent [19]

McKenna

[11] 3,966,170

[45] June 29, 1976

[54] TRACTION WINCH

[75] Inventor: Henry Alvin McKenna, Reston, Va.

[73] Assignee: Ocean Systems, Inc., Reston, Va.

[22] Filed: Sept. 13, 1973

[21] Appl. No.: 397,108

Related U.S. Application Data

[63] Continuation-in-part of Ser. No. 144,828, May 19, 1971, abandoned.

[52] U.S. Cl. ..... 254/175.7; 254/183; 74/230.17 M

[51] Int. Cl.[2] ..... B66D 1/76

[58] Field of Search ..... 254/175.5, 175.7, 173, 254/187, 183, 184, 190, 191, 150; 242/155, 155 BW, 54 R; 73/143, 144; 74/230.17 F, 230.17 M; 60/420, 451, 905; 91/412; 226/111

[56] References Cited

UNITED STATES PATENTS

| | | | |
|---|---|---|---|
| 1,939,113 | 12/1933 | Ferris | 226/111 |
| 2,024,147 | 12/1935 | Curtiss | 73/143 |
| 3,015,473 | 1/1962 | Frellsen | 254/173 R |
| 3,081,642 | 3/1963 | Emerson | 74/230.17 F |
| 3,176,543 | 4/1965 | Moore et al. | 226/111 |
| 3,243,845 | 4/1966 | Cassel | 226/111 |
| 3,285,575 | 11/1966 | Griffiths | 254/183 |
| 3,338,493 | 8/1967 | Schiffer | 60/905 |
| 3,347,525 | 10/1967 | Gregory | 254/173 R |
| 3,352,152 | 11/1967 | Abraham | 254/173 |
| 3,381,938 | 5/1968 | Betta | 242/155 BW |
| 3,435,616 | 4/1969 | Waldorff | 60/420 |
| 3,439,883 | 4/1969 | Petersen | 242/155 BW |
| 3,477,697 | 11/1969 | Schreier | 254/184 |
| 3,584,838 | 2/1968 | Tampin | 254/183 |
| 3,596,528 | 12/1968 | Dittrich | 74/230.17 F |
| 3,600,960 | 12/1968 | Karig et al. | 74/230.17 M |
| 3,606,257 | 9/1971 | Wilson | 254/175.7 |
| 3,765,614 | 10/1973 | Bartl et al. | 254/175.5 |
| 3,776,519 | 12/1973 | Hamilton | 254/175.5 |
| 3,874,173 | 4/1975 | Wilkins | 60/420 |

FOREIGN PATENTS OR APPLICATIONS

| | | | |
|---|---|---|---|
| 1,465,703 | 12/1965 | France | 254/184 |
| 296,449 | 4/1954 | France | 242/155 BW |

*Primary Examiner*—Frank E. Werner
*Assistant Examiner*—Kenneth Noland
*Attorney, Agent, or Firm*—W. R. Hulbert

[57] ABSTRACT

A power driven traction winch for drawing up rope having two spaced, parallel, power-driven drums journaled on a bearing support structure; a pulley mounted coaxially on one of the drums and free to turn with respect thereto for receiving a final turn of the rope; a pressure roller mounted on the support structure, positioned with its axis parallel to the axis of the pulley and pivoted for movement towards and away from the pulley in alignment therewith; means for urging the roller towards the pulley to press a turn of rope against the pulley; means for applying torque to the pulley in the wind-up direction, the torque being independent of rotation of and torque applied to the one drum, whereby rope is drawn into the winch under tension and released from said winch free of tension; v-shaped circumferential grooves on the drums and on the pulley for receiving turns of rope; a support structure affixed to a boat, holding the axis of the drums vertical, and wholly between said drums to provide access to said winch for rope from any direction; drive means applying equal torque in the take-up direction to each of the drums while driving the drums at speeds differing one from another, whereby stretchable rope may be hauled in with reduced slippage; hydraulic motors, one coupled to drive each of the drums, connected to a hydraulic supply providing hydraulic fluid of uniform pressure to all the motors; supporting each of the motors solely through connection of its rotor to an associated drum, with its stator restrained from rotation by a load cell connected to measure the torque applied to restrain the stator; and a brake connected between the rotor and the stator of each of said motors.

8 Claims, 4 Drawing Figures

TRACTION WINCH

CROSS REFERENCE TO RELATED APPLICATION

This is a continuation-in-part of copending application Ser. No. 144,828, filed May 19, 1971 now abandoned.

BACKGROUND OF THE INVENTION

This invention relates to traction winches.

Some present day winch systems for controlling tension on a mooring line employ a pair of parallel traction drums and a storage drum, with the rope coming from the load passing several times around the pair of traction drums and then to the storage drum. The traction drums hold the rope by friction and operate as the principal power means for drawing in or braking means for paying out line whereas the storage drum upon which the low tension end of the line is spooled, supplies the tension required to maintain the frictional forces between the rope and the traction drums. For synthetic rope to be capable of handling the high tension involved in mooring and towing applications, the rope diameter must be quite large and may in some case be as large as or greater than 20 inches in circumference. Spooling such large diameter rope on a conventional storage drum is unwieldy. Moreover, conventional storage drums are with difficulty designed to withstand the extremely high compressive forces which would be imparted thereto by such rope wound thereon even under the moderate back tension. Also, if the rope lengths are long, usually the case, the storage drum has to be inconveniently large.

In addition, in present day winch systems of the type described above, torque is unevenly distributed between the two traction drums imposing large and inefficient loads on the drive mechanism. In some instances the two traction drums may even work against each other.

A further problem with existing traction winches is that the rope elastically contracts as its tension diminishes in passing through the winch. The changing rope length, which is especially pronounced in synthetic fiber ropes, must be accommodated by sliding against the drums, with resulting rope wear.

Conventional systems using semi-circular grooves must make many turns around the traction drums to develop adequate friction. This causes very high bearing loads on the drum shafts. This problem can be partly alleviated by making successive grooves for the rope turns smaller in diameter, but a different ratio of variation is required for each tension or rope material prohibiting general use of the equipment.

SUMMARY OF THE INVENTION

One aspect of the invention features a power driven traction winch for drawing up rope having two spaced, parallel, power-driven drums journaled on a bearing support structure, a segment of rope intermediate its ends being wound during drawing around the drums, a pulley mounted coaxially on one of the drums and free to turn with respect thereto for receiving a final turn of the rope, a pressure roller mounted on the support structure, positioned with its axis parallel to the axis of the pulley and pivoted for movement towards and away from the pulley in alignment therewith, means for urging the roller towards the pulley to press a turn of rope against the pulley, and means for applying torque to the pulley in the wind-up direction, the torque being independent of rotation of and torque applied to the one drum, whereby rope is drawn into the winch under tension and released from said winch free of tension. A preferred embodiment of the invention additionally features v-shaped circumferential grooves on the drums and on the pulley for receiving turns of rope, and a support structure affixed to a boat, holding the axis of the drums vertical, and wholly between said drums to provide access to said winch for rope from any direction.

Another aspect of the invention features drive means applying equal torque in the take-up direction to each of the drums while driving the drums at speeds differing one from another, whereby stretchable rope may be hauled in with reduced slippage.

A preferred embodiment of the invention further features a plurality of hydraulic motors, one coupled to drive each of the drums, and connected to a hydraulic supply providing hydraulic fluid of uniform pressure to all the motors; supporting each of the motors solely through connection of its rotor to an associated drum, with its stator restrained from rotation by a load cell connected to measure the torque applied to restrain the stator; and a brake connected between the rotor and the stator of each of said motors.

DESCRIPTION OF PREFERRED EMBODIMENT

Figure 1:
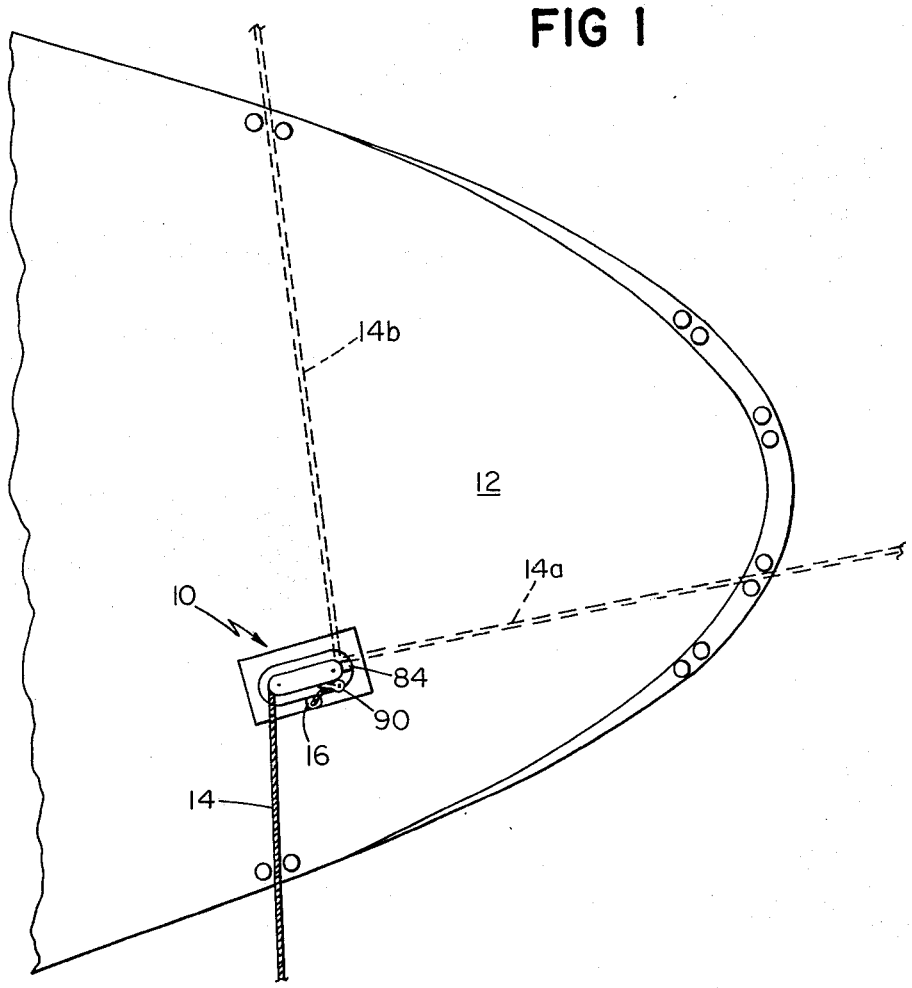
FIG. 1 shows a winch according to the invention mounted on the deck of ship with alternative paths for rope running to the winch.

Traction winch 10, according to the invention, is shown in FIG. 1 installed on the deck 12 of a ship. Rope 14 running from a mooring point not shown is brought up to traction winch 10, wound around the winch and then passed through port 16 to storage space below the deck 12. The rope from the mooring point may be run up to the winch indiscriminently from a variety of directions as shown by the alternative positions of the rope 14*a* and 14*b*.

Figure 2:
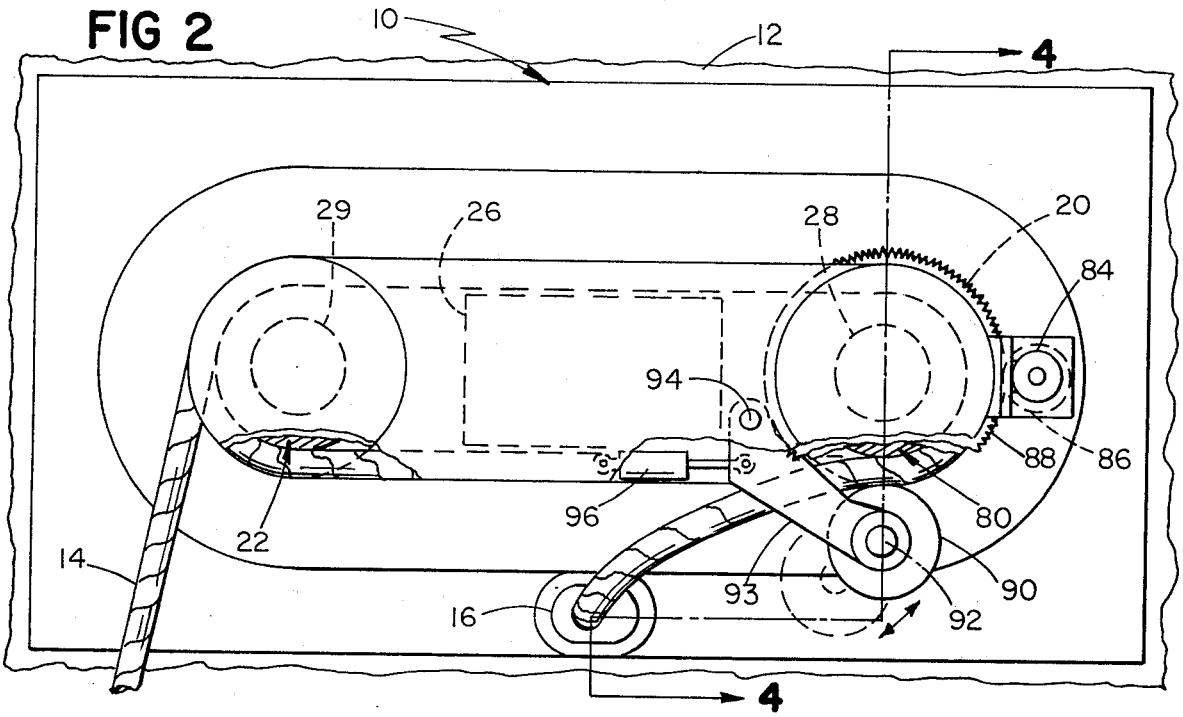
FIG. 2 shows a plan view of the winch of FIG. 1 in greater detail and with some portions cut away to reveal interior parts.
Figure 4:
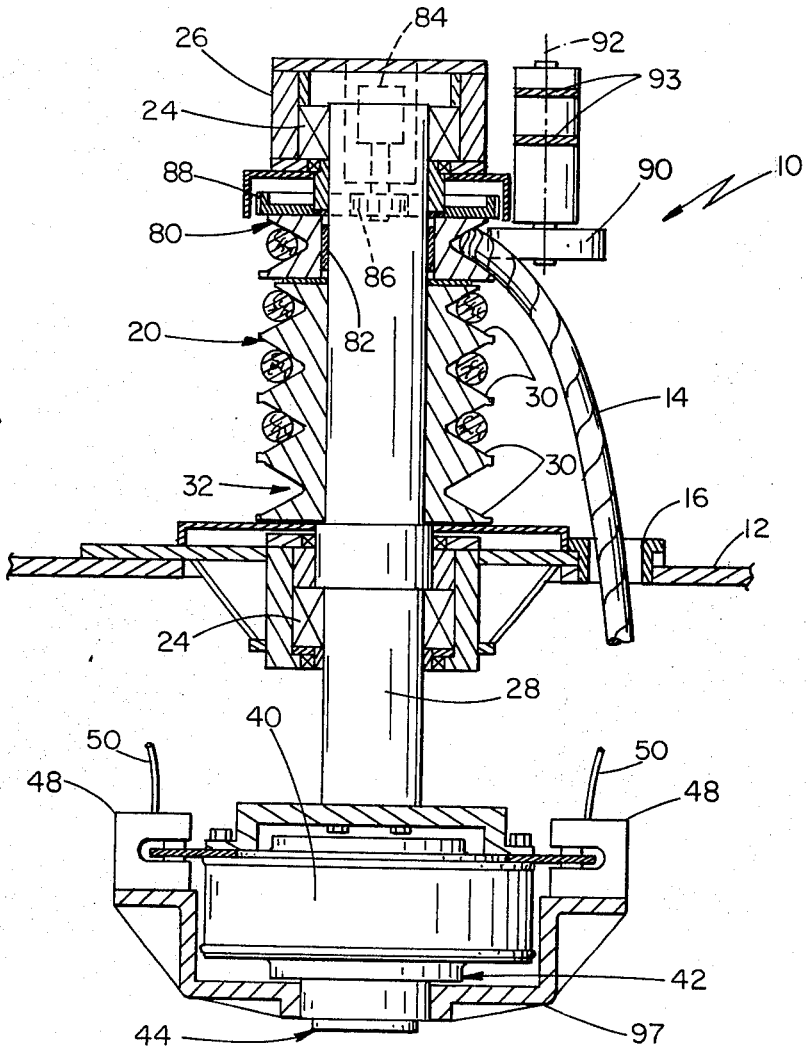
FIG. 4 shows a section through the winch as indicated in FIG. 2.
Figure 3:
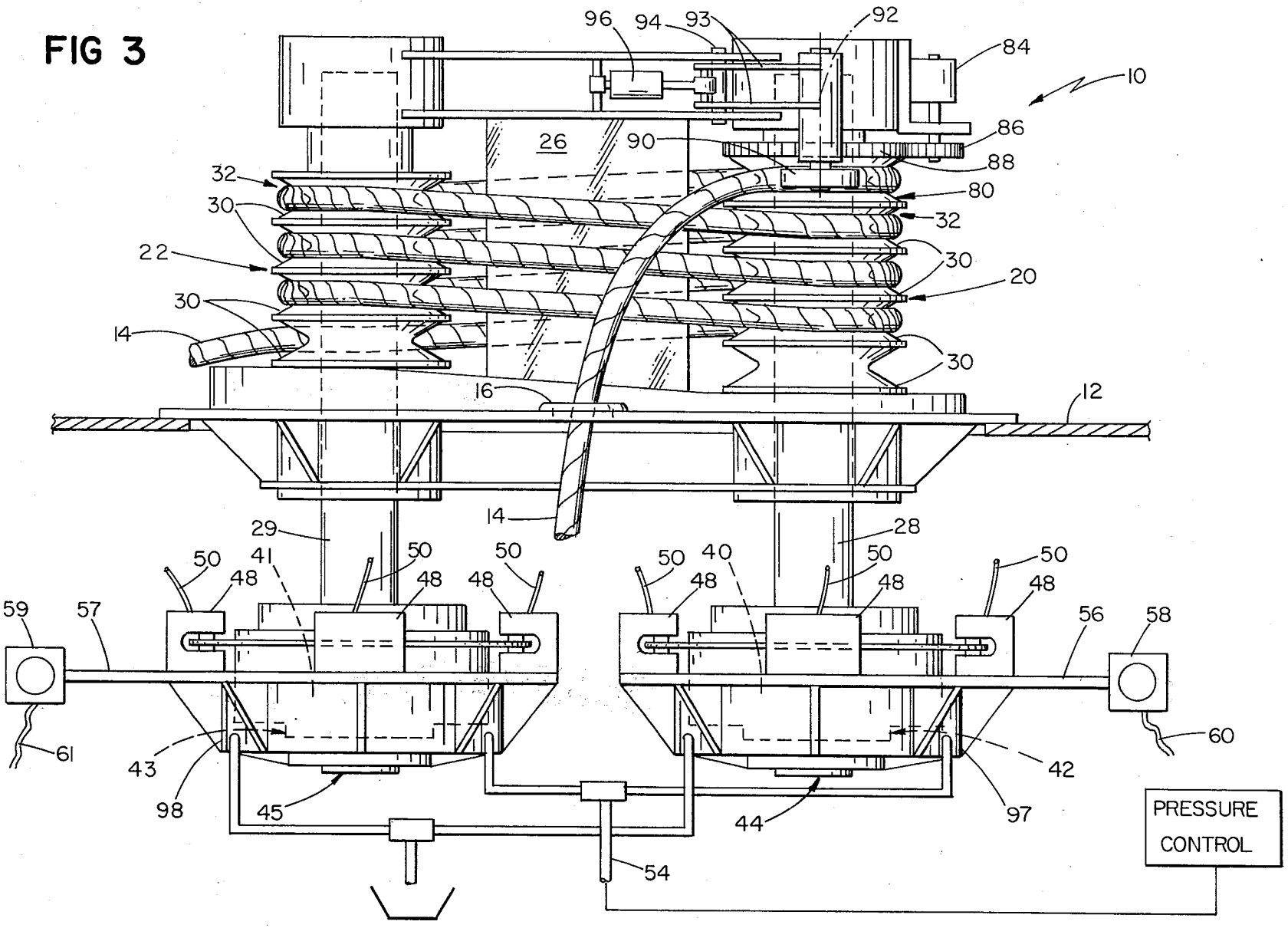
FIG. 3 shows an elevation view of the winch of FIGS. 1 and 2.

As shown more particularly in FIGS. 2, 3, and 4, winch 10 includes two drums 20 and 22, which are supported in parallel with each other in a vertical orientation by bearings 24 mounted in bearing support structure 26. Bearing support structure 26 is situated wholly between drums 20 and 22 and is affixed to deck 12. Drums 20 and 22 include drive shafts 28 and 29 respectively to which are affixed several annular disks 30, each disk having a v-shaped groove running around its periphery. The longitudinal positions of the grooves on one drum are staggered with respect to those on the other drum.

Drive shafts 28 and 29 extend downward below deck 12 and are attached to rotors 40 and 41 of hydraulic motors 42 and 43 respectively. The stators 44 and 45 of motors 42 and 43 are supported solely by their respective drive shafts through the motor bearings. Brake support housings 97 and 98 are affixed to stators 44 and 45 respectively. Hydraulic motors 42 and 43 are of identical design and are manifolded together to a single source of hydraulic power applied through line 54 from pressure control unit 55 so that the hydraulic pressure supplied to one motor is the same as that applied to the other, thus ensuring that the two motors will develop equal torque. Torque arm 56 is affixed to the brake support housing 97 and extends to bear upon load cell 58. Similarly, arm 57 extends from the brake support housing 98 to load cell 59. The outputs from load cells 58 and 59 are connected to conventional readout or display systems not shown, through leads 60 and 61 respectively. Hydraulic brakes 48 are installed on brake support housings 97 and 98 and are operated through hydraulic control lines 50.

Immediately above the fixed annular disks 30 on shaft 28, tensioning pulley 80 is mounted. Pulley 80 is contoured with a v-shaped groove in its outer periphery and is journaled on bearing 82 for rotation with respect to shaft 28. Hydraulic motor 84 is supported on support structure 26, and drives pulley 80 through gears 86 and 88.

Pressure roller 90 with axis 92 parallel to the axis of drums 20 and 22 is supported on roller arm 93 which in turn is mounted through pivot 94 on structure 26 permitting roller 90 to move towards and away from pulley 80. Hydraulic cylinder 96 is connected between roller arm 93 and structure 26 to control the position and forces on roller 90.

In operation, a section of rope 14 intermediate its ends is wrapped in helical fashion around drums 20 and 22, with the rope lying in the grooves 32 of the disks 30. The high tension end of the rope coming from the mooring point is led into the lowest disk 30 of one or the other of drums 20 or 22, depending upon the direction of approach of the rope to the winch. Successive loops of rope are wound about successively higher grooves. The final turn of the rope is taken around grooved pulley 80 from which the rope passes through port 16 to storage. After the rope is wound around the winch as described, hydraulic cylinder 96 is actuated to move roller 90 towards pulley 80 and press the rope firmly against pulley 80. Hydraulic motors 42 and 43 are then actuated to apply torque to drums 20 and 22, and hydraulic motor 84 is actuated to apply torque to pulley 80 in the take-up direction. The rope is pressed into the v-shaped groove of pulley 80 by roller 90 and is gripped by frictional forces and tightens the rope against the fixed disks 30 of the two drums, which in turn apply tension to the rope running to the mooring point. Torque in the take-up direction is maintained in pulley 80 at all times while the winch is in operation either hauling in or paying out rope. The v-shaped grooves in pulley 80 and in disks 30 are particularlry effective in generating frictional forces with the rope so that the tension in the rope rapidly mounts in the direction towards the high tension end. The very large tension corried by the rope as it comes from the mooring point is thus transmitted through frictional forces to the winch over a short run of rope while the rope running off pulley 80 is delivered to storage without tension.

Since, as the rope moves through the winch, its tension is reduced, it undergoes a corresponding elastic contraction in length. This contraction is especially important during the first turn of the rope at the high tension side, where a large part of the tension from the mooring end is transferred to the winch. Because of the rope contraction, the length of rope passing around the first contacted disk 30 on drum 22 (supposing the rope to approach the winch as shown) is greater than the amount of rope passing around the first disk contacted on drum 20. Motors 42 and 43 will develop and apply equal torques to drums 20 and 22 because they are supplied by hydraulic fluid at a common pressure, but motor 43 will drive drum 22 faster to accommodate the greater length of rope taken in at the higher tension. At the same time, the independent driving of pulley 80 by hydraulic motor 84 assures that a proper initial tension will be placed on the rope at all times irrespective of extension or contraction of rope as it passes through the winch.

Since the stator 44 of motor 42 is affixed only to brake support housing 97 which is not affixed to any structure, the torque developed in the motor and applied to shaft 28 is transmitted entirely to the ship's deck through torque arm 56, which provides the sole constraint preventing stator 44 and brake support housing 97 from rotating. The force exerted by arm 56 on load cell 58 therefore is proportional to the torque appliled to drum 20, and the load cell output gives an indication of that torque. A similar stator construction and load cell is employed to measure the torque applied to drum 22. It may be noted that each load cell gives an indication of the torque applied to its respective drum irrespective of whether the torque is generated by the operation of the hydraulic motors during hauling in or by brakes 48 during paying out of rope. The torque applied to the winch drums can of course readily by interpreted to give tension on the rope.

The use of a driven tensioning pulley together with a pressure roller advantageously establishes tension on the rope within the winch so that the drums can build up the tension by friction to the level of the load while the slack end of the rope is delivered for storage completely free of tension. The vertical orientation of the drum axis together with the mounting of the tensioning pulley on one of the drum shafts and confining the support structure to the region between the drums makes it possible to lead the rope directly to the winch from any direction and also permits storage of rope without auxiliary blocks or runs of rope across the deck. The multiple v-grooves give high frictional forces which is advantageous in establishing a firm tensioning force in the turn around the tensioning pulley. The v-grooves have further advantages in giving a rapid build-up of tension in the drums so that fewer turns of rope are needed to hold the rope on the winch, with resulting lower bearing loads. The use of a separate hydraulic motor for each drum permits faster rotation of one drum than the other and so accommodates the contraction of the rope as it passes through the winch, thus reducing rope slippage and wear. This advantage is particularly important in handling synthetic fiber ropes which are more stretchable than steel cables. The support of the motor stators solely through the drum bearings, together with constraining the stators from rotation by an arm bearing on a load cell, gives an accurate measurement of torque applied to the drums and tension applied to the rope.

Additional embodiments and advantages of the invention will be apparent to those skilled in the art and are within the following claims.

I claim:

1. A power driven traction winch for drawing up rope having two spaced, parallel, power-driven drums journaled on a bearing support structure, a segment of rope intermediate its ends being wound during drawing around said drums, including a pulley mounted for receiving a final turn of said rope, a pressure roller mounted with its axis parallel to the axis of said pulley and pivoted for movement towards and away from said pulley in alignment therewith, means for urging said roller towards said pulley to press a turn of rope against said pulley, and means for applying torque to said pulley in the wind-up direction, said torque being independent of rotation of and torque applied to said drums, whereby rope is tightened into said winch under all operating conditions and released from said winch free of tension.

2. Apparatus as claimed in claim 1, said pulley having a v-shaped circumferential groove.

3. In a traction winch for drawing up rope having a plurality of parallel drums spaced apart and rotatably mounted on a support structure, a segment of rope intermediate its ends being wound during drawing around said drums, the improvement comprising drive means applying equal torque in the take-up direction to each of said drums and being directly responsive to the rope tension between said drums while leaving said drums free to automatically accommodate to varying rope stretch by rotating at speeds differing in varying ratio responsive directly to varying rope stretch, whereby stretchable rope may be hauled in with reduced slippage.

4. Apparatus as claimed in claim 3, each of said drums having a plurality of circumferential grooves thereon for receiving a turn of rope, said grooves having a v-shaped cross section.

5. Apparatus as claimed in claim 4, said support structure being affixed to a boat and holding the axis of said drums vertical, said support structure being wholly between said drums to provide access to said winch for rope from any direction.

6. Apparatus as claimed in claim 3, including a plurality of hydraulic motors, one coupled to drive each of said drums, said hydraulic motors being connected to a hydraulic supply providing hydraulic fluid of uniform pressure to all said motors.

7. Apparatus as claimed in claim 6, each of said motors being supported solely through connection of its rotor to an associated drum, and having its stator restrained from rotation by a load cell connected to measure the torque applied to restrain the stator.

8. Apparatus as claimed in claim 7, including a brake connected between the rotor and the stator of each of said motors.

* * * * *